United States Patent [19]

McCracken

[11] Patent Number: 4,569,501

[45] Date of Patent: Feb. 11, 1986

[54] CAMBERED TRUSS HEADER FOR A SHORING STRUCTURE

[75] Inventor: Robert G. McCracken, Des Moines, Iowa

[73] Assignee: Economy Forms Corporation, Des Moines, Iowa

[21] Appl. No.: 614,543

[22] Filed: May 29, 1984

[51] Int. Cl.[4] ..... E04G 11/54

[52] U.S. Cl. ..... 249/209; 52/641; 52/644; 52/645; 249/18; 249/19; 249/210

[58] Field of Search ..... 52/639, 640, 641, 643, 52/644, 632, 645, 646; 249/18, 210, 211, 19, 23, 24, 25, 209, 212

[56] References Cited

U.S. PATENT DOCUMENTS

| | | | |
|---|---|---|---|
| 2,916,111 | 12/1959 | Pleitgen et al. | 249/210 |
| 2,985,264 | 5/1961 | Leonard, Jr. | 52/640 |
| 3,019,491 | 2/1962 | Troutner | 52/644 |
| 3,336,717 | 8/1967 | Ward, Jr. et al. | 52/640 |
| 3,778,946 | 12/1973 | Wood et al. | 52/640 |
| 3,826,057 | 7/1974 | Franklin | 52/641 |
| 3,899,152 | 8/1975 | Avery | 249/18 |
| 4,106,256 | 8/1978 | Cody | 52/646 |

FOREIGN PATENT DOCUMENTS

| | | | |
|---|---|---|---|
| 759703 | 10/1956 | United Kingdom | 52/640 |

OTHER PUBLICATIONS

"Flying Forms", Alumina-Systems sales brochure, Alumina Building Systems, Inc., Ontario, Canada.

*Primary Examiner*—Jay H. Woo
*Assistant Examiner*—James C. Housel
*Attorney, Agent, or Firm*—Rudolph L. Lowell

[57] ABSTRACT

The cambered truss header is embodied in a shoring apparatus for pouring substantially horizontal concrete building sections. The truss header extends between and is supported on end runners which may be carried on floor-supported legs or on hangers mounted on upright building sections. A truss header may consist of a truss span having a top chord member, a bottom chord member, and a plurality of like brace members interconnecting the chord members. The brace members form an open web pattern wherein adjacent brace members are reversely inclined with the plurality of apices being connected to the top chord members a spaced apart distance greater than the spaced apart distance between the apices of the bottom chord member. The truss header is thus provided with a camber which tends to assume a horizontal position in response to a load placed on the truss header by the horizontal concrete building section. By arranging a pair of truss spans side-by-side for relative longitudinal movement, the truss header may be adjustable in increments equal to the spaced apart distance between the connected apices of the brace members to accommodate spans of different widths.

1 Claim, 9 Drawing Figures

18
14
3
22
16
17a
24
20
50
17
15
26
44
2
28
30
34
32
14

28
61
26
38
36
30
40
42
36
15
49
26
35
44
34

FIG. 6
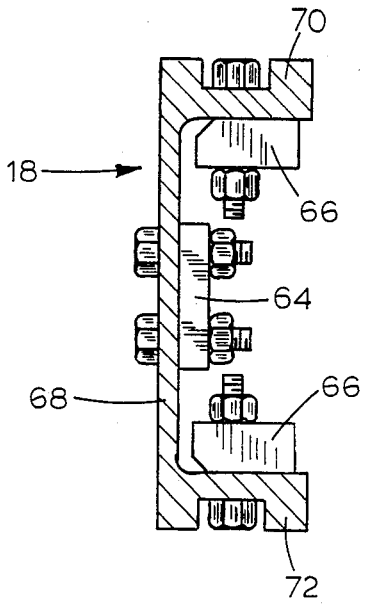
FIG. 5
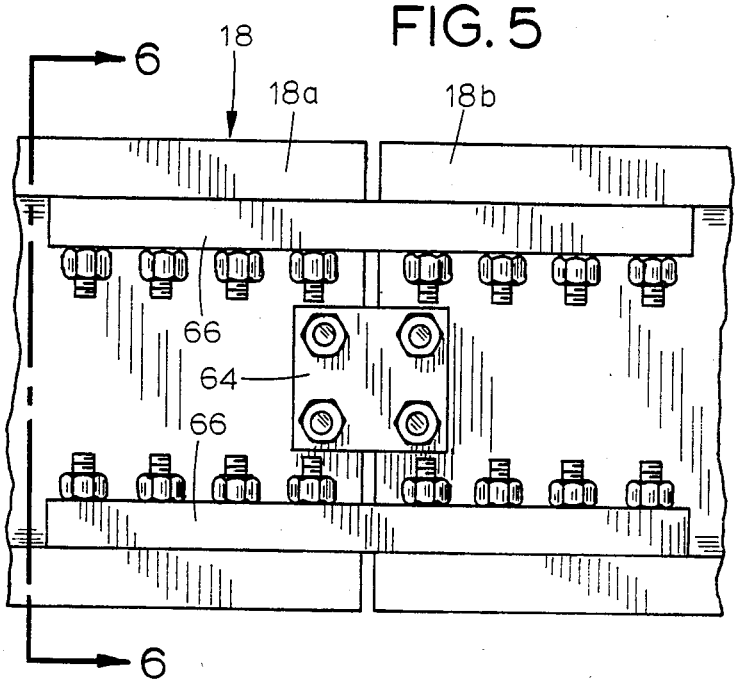
FIG. 7
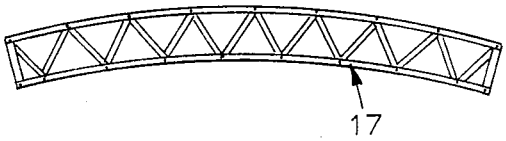
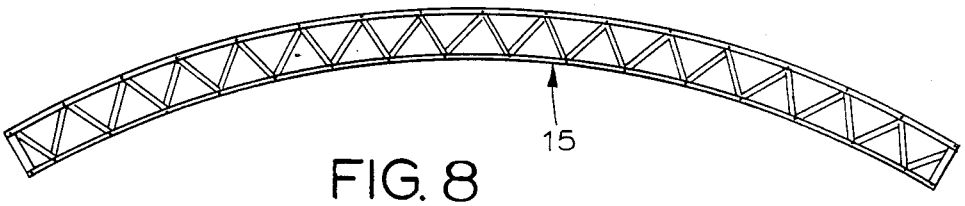
FIG. 8
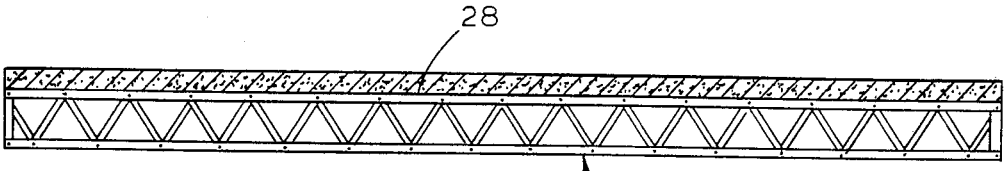
FIG. 9

CAMBERED TRUSS HEADER FOR A SHORING STRUCTURE

BACKGROUND OF THE INVENTION

This invention relates to a truss header for use in adjustable shoring structures. More particularly, the invention relates to a truss header employed in unitary concrete form assemblies known as flying slabs which is of an adjustable length and provided with an unweighted camber whereby the truss header will tend to straighten or flatten out horizontally in response to applied loading conditions.

Adjustable shoring systems made of reusable form components are conveniently and efficiently used in the construction of concrete floors in office buildings, high-rise structures and the like. The form components can be easily and quickly assembled and thereafter removed for transport to another pour site. Because efficiency can be increased by pouring concrete floors across large spans, shoring systems for the pouring of floors across spans of up to thirty feet are manufactured in modular form. These assemblies are preferably of the flying slab type, such as that disclosed in U.S. Pat. Nos. 3,899,152 and 4,106,256, wherein combinations of shoring apparatus and deck forms are designed to be placed in side-by-side and end-to-end relation to provide a continuous deck form which serves as a base for the poured concrete.

The thickness of a poured concrete floor may be up to twelve inches for a span of twenty-three feet. The weight or load of such a quantity of concrete requires a heavy conventional truss to maintain the floor level within the usual tolerances. As the thickness of the floor to be poured and the span length increases, so does the weight of a truss constructed to provide adequate support. Additionally, the heavier supporting apparatus requires a larger and more expensive crane to "fly" the modular assemblies between pour sites.

The truss header of the present invention offers an improved supporting assembly for pouring long span concrete floors. The truss header is designed with a camber which tends to straighten out in response to the applied load of the poured concrete whereby a lighter-weight material, such as aluminum, can be used in its construction to efficiently carry a predetermined load.

SUMMARY OF THE INVENTION

In the invention, a truss header assembly is employed with a shoring apparatus that includes a beam or runner at each end of the truss header carried either on floor-supported adjustable legs or on hangers mounted on the concrete walls or columns of the building. Each truss header may include a pair of side-by-side truss spans having end sections which overlap at the center portion of the truss header by an amount providing linear adjustment of the truss header to a plurality of working lengths. Each truss span includes a top chord equipped with a plurality of transverse connecting cylinders uniformly spaced a predetermined distance apart longitudinally of the top chord. Each bottom chord of a truss span is also equipped with a plurality of transverse connecting cylinders uniformly spaced a predetermined distance apart longitudinally of the bottom chord, and which spacing is slightly less than the spacing of the connecting cylinders for the top chord. The top and bottom chords of each truss span are connected together by a plurality of alternately reversely inclined brace members of equal length. The adjacent ends of adjacent reversely inclined brace members are secured to a common connecting cylinder on the top and bottom chord, whereby to form a truss span having a camber with a radius of curvature determined by the difference in the spacing of the connecting cylinders on each chord and the length of the brace members. This radius is typically between fifty and two hundred and fifty times the length of a truss span. The braces of the truss header form a series of connected V-shape structures wherein the apex of a V occurs at each connecting cylinder on the chords, with an apex on one chord being radially opposite the midpoint between two adjacent connecting cylinders on the other chord.

BRIEF DESCRIPTION OF THE DRAWINGS

FIG. 5 is an enlarged elevational view showing a splice connection between sections of the runners of a shoring structure;

FIG. 6 is a sectional view taken along line 6—6 of FIG. 5;

FIG. 7 is a schematic view of a single cambered truss span or header;

FIG. 8 is a schematic view of a cambered truss header comprised of a pair of truss spans connected at overlapping end portions; and FIG. 9 is a schematic view of a cambered truss header which has been depressed or flattened out to a substantially horizontal position in response to the weight of a concrete floor section poured thereon.

DETAILED DESCRIPTION OF THE PREFERRED EMBODIMENT

Figure 1:
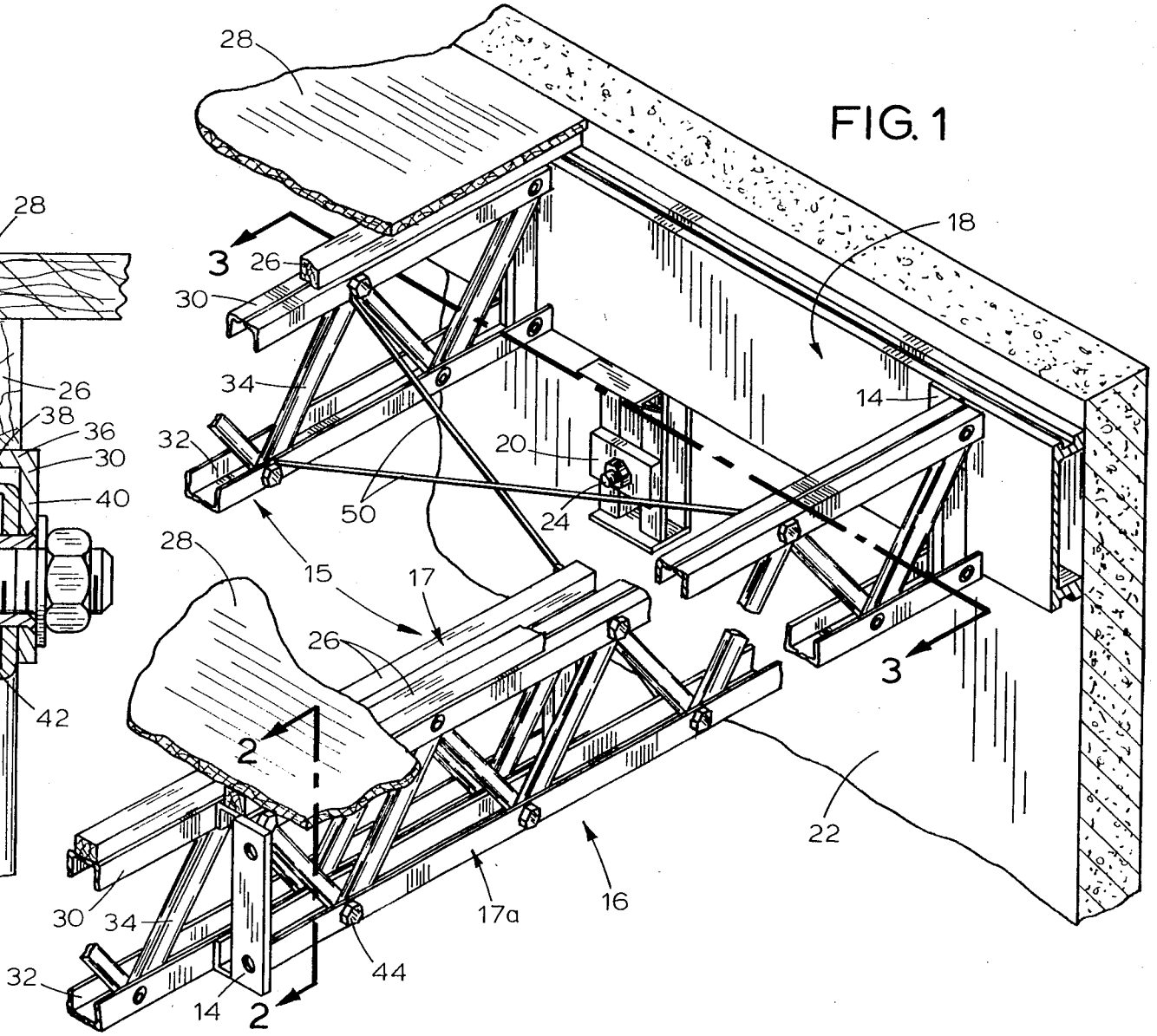
FIG. 1 is a fragmentary foreshortened perspective view showing the assembly of a pair of truss headers carried by a runner mounted on a concrete wall.

With reference to FIG. 1 of the drawings, there is illustrated a shoring apparatus, indicated generally at 16, including portions of a pair of adjustable truss headers 15 of this invention the opposite ends of which are carried by beams, or runners, one of which is illustrated at 18. Each truss header 15 is comprised of a pair of single headers or truss spans 17 and **17*a*** joined at overlapping end portions thereof as will be described in detail later.

Each end of a truss span 17 and **17*a* has a laterally projected integral mounting flange 14 which extends substantially over the entire vertical height of a truss span. The mounting flange 14 at the outer end of each truss span 17 and 17*a* is removably secured to an adjacent runner 18 by a conventional fastener, such as a bolt and nut assembly (not shown), which passes through aligned holes of the flanges 14 and the runners 18. In a similar manner, a plurality of truss headers 15 are assembled with the runners 18** in a spaced parallel relation.

The shoring apparatus 16 is supported by mounting units or hangers 20 secured to a concrete building section 22. Each hanger 20 is removably attached to the building section 22 by a tie bolt 24 and has a substantially flat top surface or pedestal, upon which rests the bottom surface of a runner 18. A wooden joist member 26 (FIG. 2) extends longitudinally of and on the top surface of each truss span 17 and 17*a* for attachment of sheeting 28 to form a deck, as shown in FIG. 1.

Since the truss spans 17 and 17*a* of an adjustable truss header 15 are similar in construction only the truss span 17 will be described in detail with like numbers applied to like parts.

Figure 2:
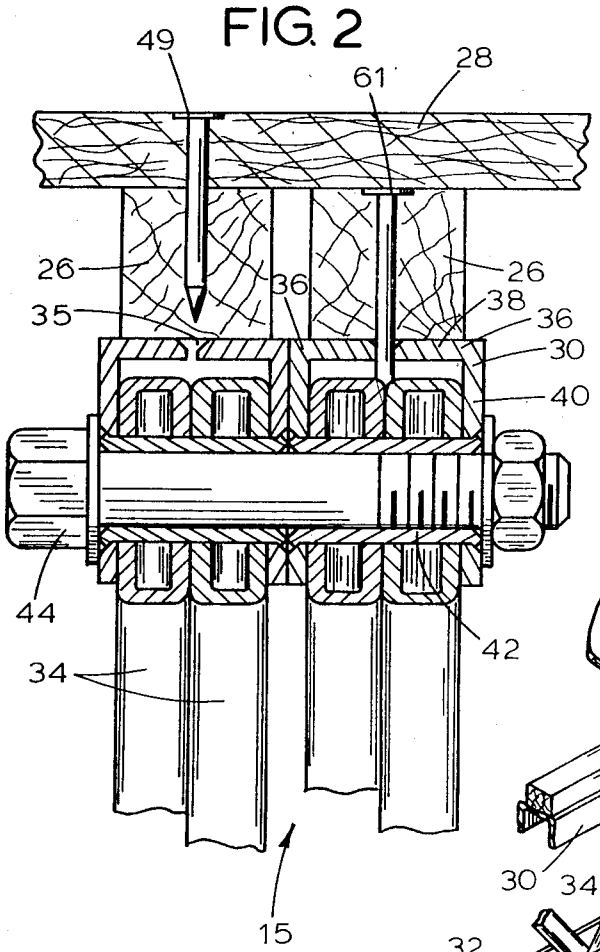
FIG. 2 is an enlarged cross-sectional view of the top chords of a truss header taken along the line 2—2 of FIG. 1.

The truss span 17 includes a top chord 30, and a bottom chord 32, interconnected by a plurality of tubular brace members 34. As best illustrated in FIG. 2, the top chord 30 and bottom chord 32 are each formed of a pair of angle members 36 having horizontal top flanges 38 and vertical side flanges 40. Each pair of angle members 36 have the horizontal flanges 38 positioned opposite each other in a spaced relation such that the top chord 30 is of a generally channel shape with the side flanges 40 projected downwardly and the bottom chord 32 is of a generally channel shape with the side flanges 40 extended upwardly. The side flanges 40 of the top chord 30 are formed with holes spaced longitudinally apart a predetermined distance or increment. Similarly, the side flanges 40 of the bottom chord 32 are formed with holes spaced apart a predetermined distance or increment which is slightly less than the increment spacing of the holes in the side flanges 40 of the top chord 30.

The plurality of brace members 34 are of equal length and of a rectangular shape in transverse cross section. Each brace member 34 is formed adjacent each end thereof with a hole or a bore and with the centers of the holes in each brace member 34 being spaced apart a distance common to each of the plurality of brace members 34.

In the construction of a truss span 17 or 17*a* the contiguous ends of a pair of adjacent brace members 34 are inserted between the flanges 40 of the angle members 36 of the chords 30 and 32 and the holes therein aligned with a pair of the holes formed in the side flanges 40 of the angle members 36. An unexpanded rivet sleeve is then inserted with an expander tool into the aligned holes and expanded to form a connecting sleeve 42 which connects the angle members 36 of each chord 30 and 32 with the associated end portions of the adjacent brace members 34.

In the assembly of a truss span 17 or 17*a* a connecting sleeve 42 of the bottom chord 32 is positioned opposite the midpoint between adjacent connecting sleeves of the top chord 30 and a connecting sleeve 42 in the top chord 30 opposite the midpoint between adjacent connecting sleeves of the bottom chord 32. Each adjacent pair of connected brace members 34, therefore, are reversely inclined so as to form a longitudinally extended multiple V-shape pattern or web for transferring to the bottom chord forces applied to the top chord. By virtue of the spacing between adjacent connecting sleeves at the top chord 30 being slightly greater than the spacing between adjacent connecting sleeves 42 of the bottom chord 32, a camber is formed in a truss span. The camber of a typical truss span is exaggerated and schematically illustrated in FIG. 7.

The radius of curvature of a truss span 17 and 17*a* is given by the following formula: $R=YD/(Y-X)$, wherein R is the radius of curvature of the truss span 17; Y is the distance between adjacent connecting sleeves 42 at the top chord 30; X is the distance between adjacent connecting sleeves 42 at the bottom chord 32; and D is the linear distance along a radius of curvature between the center of a connecting sleeve 42 on one of the chords 30 or 32 and the midpoint between adjacent connecting sleeves of the other chord. In one embodiment of the invention wherein the truss header is made of aluminum, the centers of the connecting sleeves in the top chord 30 are spaced 18.00 inches apart (distance Y); the centers of the sleeves 42 in the bottom chord 32 are spaced 17.9595 inches apart (distance X); and the linear radial distance between the top and bottom chord connecting sleeves 42 is 18.00 inches (distance D), to provide a radius of curvature of 8000 inches, or 666 feet, 8 inches. The midpoint of an eighteen foot truss span having the above component dimensions and with the centers of the holes in a brace member 34 spaced 20.125 inches apart is raised three-quarters of an inch above a horizontal plane extended through the ends of a chord 30 or 32.

A pair of the truss spans 17 and 17*a* are joined at overlapping end portions thereof to form a truss header 15 (FIG. 1) which is adjustable in length in increments equal to the spaced apart distance of the connecting sleeves 42. A nut and bolt assembly 44 (FIG. 2) is inserted into the aligned connecting sleeves 42 to secure the truss spans in an adjusted position. Since each truss span 17 and 17*a* is formed with a similar camber, such camber will be maintained in the truss header 15 at any adjusted length thereof. FIG. 8 illustrates diagrammatically a truss header 15 in a relaxed condition, and FIG. 9 the horizontal positioning of the truss header 15 under load.

Figure 3:
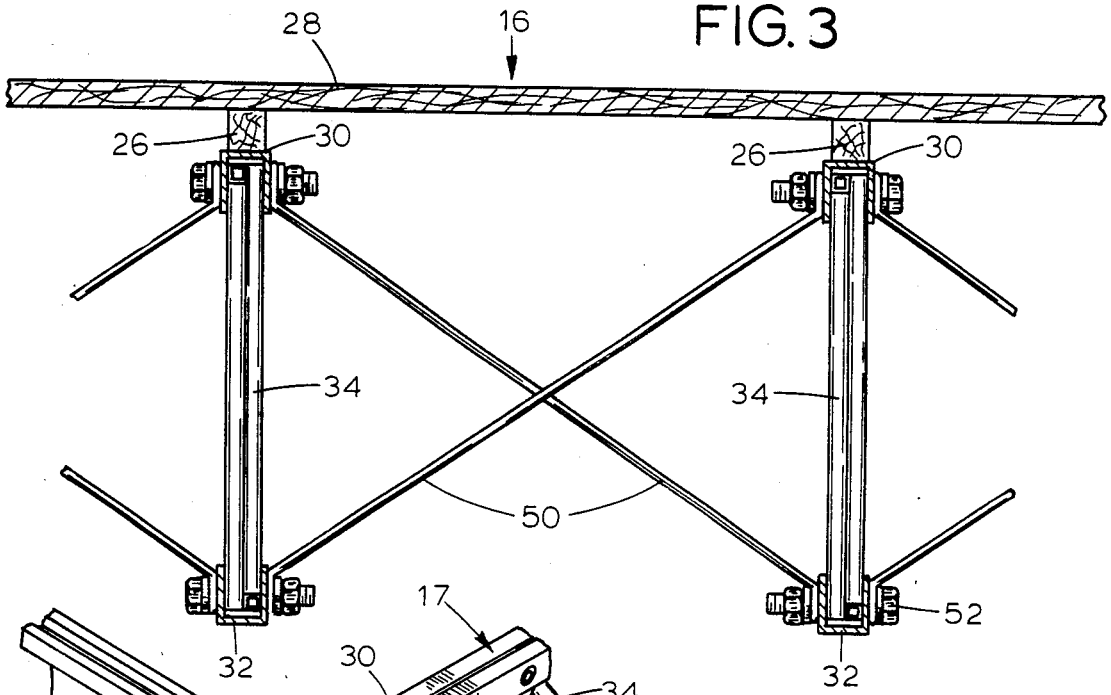
FIG. 3 is a cross-sectional view taken along the line 3—3 of FIG. 1 of a shoring apparatus showing bridging rods connected between adjacent truss headers.

The shoring apparatus 16 may be provided with additional rigidity by the addition of bridging rods 50, as illustrated in FIGS. 1 and 3. Each bridging rod 50 is extended between and connected to selected connecting sleeves 42 of the truss spans 17 and 17*a* by nut and bolt assemblies 52. The bridging rods 50 tend to brace the headers 15 against lateral tilting movement.

The deck upon which the concrete of a floor section is to be poured is formed by the sheeting 28 (FIG. 1) which is preferably made of plywood. A wooden joist member 26 is fastened to one of the top chords 30 by screws or nails 51 driven through the wooden joist member 26 and into the slot or space 35 between the horizontal flanges 38 of the angle members 36 of the top chord 30, as illustrated in FIG. 2. The sheeting 28 is then fastened to the wooden joist member 26 by screws or nails 49. The deck 28 is similarly assembled with the truss spans 17 and 17*a* (FIG. 7) whether the spans are used singly or in combination in a truss header 15 (FIG. 8), depending on the width of the span of the horizontal concrete section to be poured.

Figure 4:
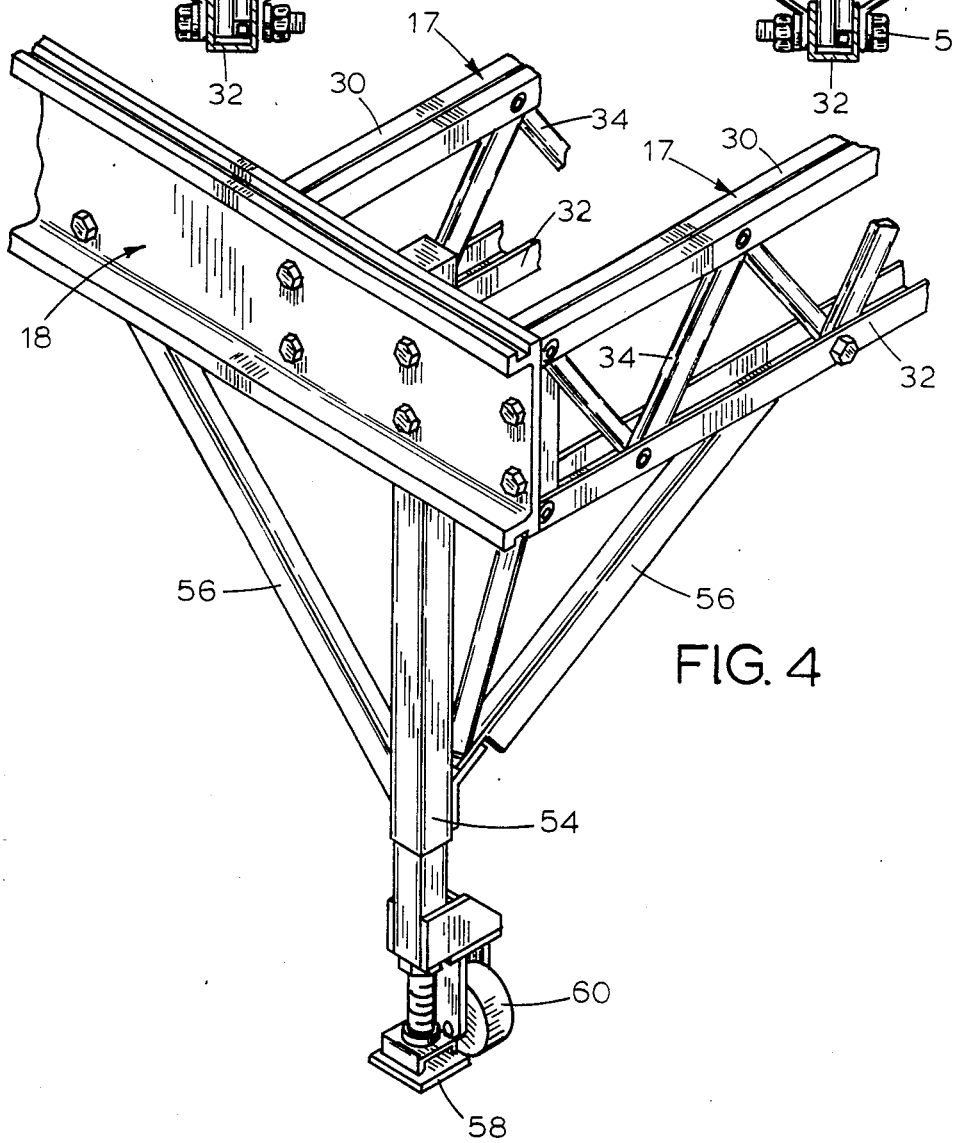
FIG. 4 is a fragmentary perspective view of a corner of a shoring apparatus showing the runner thereof carried on a floor-supported leg.

In one embodiment, as illustrated in FIG. 1, the shoring apparatus 16 is supported on the hangers 20 secured to a concrete building section 22. Alternatively, the shoring apparatus 16 may be supported on a plurality of floor-supported legs, one of which is illustrated in FIG. 4 at 54. The upper end portion of the leg 54 is suitably secured as by braces 56 to a runner 18 and to the truss spans 17 and 17*a*. The bottom portion of the leg 54 has an adjustable stabilizing foot 58 and a caster wheel 60. In use, the foot 58 is adjusted downwardly from the leg 54 to elevate the caster wheel 60 and support the shoring apparatus 16 at the desired height. When the poured concrete has set, the foot 58 is fully retracted, whereupon the deck 28 is broken loose and the leg 54 is supported on the caster wheel 60 for easy transport to the next pouring site.

The runners 18 are formed of sections 18*a* and 18*b* (FIGS. 5 and 6) joined in an end-to-end relation. Each runner section 18*a* and 18*b* is of a channel shape as illustrated in FIG. 6, and includes a substantially vertical portion or web 68 and horizontally extended legs 70 and 72. The sections 18*a* and 18*b* are joined by a splice plate 64 and a pair of splice bars 66. The splice plate 64 connects the webs 68 of adjacent runner sections, and the splice bars 66 are bolted to the lower legs 72 and upper legs 70 of the runner sections 18*a* and 18*b*.

It is preferred that the major components of the truss header 15 and the runners 18 be comprised of extruded aluminum to provide a lightweight structure with efficient load carrying characteristics. The present invention provides a camber to the unloaded truss spans 17 and 17*a* and truss header 15 as illustrated in FIGS. 7 and 8, respectively. The heavy load of concrete placed on the deck 28 causes the truss spans to straighten out or assume horizontal positions as illustrated in FIG. 9. The amount or value of the camber of the unloaded truss span is such that the span or assembled header will straighten out to a substantially horizontal position under the predetermined load of the concrete floor section to be poured.

Although the invention has been described with respect to a preferred embodiment thereof, it is to be understood that it is not to be so limited since changes and modifications can be made therein which are within the full intended scope of this invention as defined by the appended claims.

I claim:

1. In a shoring apparatus for use in forming substantially horizontal concrete sections having a plurality of extendable and retractable truss headers extended between and supported on end runners, with each truss header comprising:

(a) a pair of truss spans having inner end sections positioned in a side-by-side relation for relative longitudinal movement, with each truss span including a top chord member and a bottom chord member and brace members extended between and connected to said chord members with adjacent brace members reversely inclined, and (b) tubular means for connecting together the adjacent ends of adjacent brace members, (c) with the tubular connecting means on the top chord member of each truss span spaced apart a distance slightly greater than the spaced apart distance of the tubular connecting means on the bottom chord member of each truss span to provide a predetermined and like camber in each truss span relative to the load to be applied on the truss header, and (d) the inner end sections of the truss spans having the tubular connecting means thereon opposite each other to provide for the extension and retraction of the truss header in increments equal to the spaced apart distances of the tubular connecting means on the top chord member and the bottom chord, and (e) securing means extendible through said opposite tubular connecting means.

* * * * *